US006655287B2

(12) United States Patent
Jojima et al.

(10) Patent No.: US 6,655,287 B2
(45) Date of Patent: Dec. 2, 2003

(54) PRINTING APPARATUS AND PRINTING METHOD

(75) Inventors: Yosuke Jojima, Kanagawa-ken (JP); Kenichi Araki, Chiba-ken (JP); Hiroyuki Mori, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/217,014

(22) Filed: Aug. 13, 2002

(65) Prior Publication Data

US 2003/0056675 A1 Mar. 27, 2003

(30) Foreign Application Priority Data

Sep. 21, 2001 (JP) ..... P2001-290255

(51) Int. Cl.[7] ..... B41F 1/16

(52) U.S. Cl. ..... 101/485; 400/24; 400/120.01; 347/213; 347/221; 101/492

(58) Field of Search ..... 101/483, 485, 101/484, 492, 225, 232, 90; 400/24, 120.01; 347/187, 193, 175, 176, 213, 215, 217, 221

(56) References Cited

U.S. PATENT DOCUMENTS 4,197,797 A * 4/1980 Rayfield et al. ..... 101/90
5,634,731 A 6/1997 Kita et al.
5,798,841 A * 8/1998 Takahashi ..... 358/296
5,956,067 A * 9/1999 Isono et al. ..... 347/176
6,027,780 A * 2/2000 Treleaven et al. ..... 428/40.1
6,088,048 A * 7/2000 Soshi ..... 347/188
6,108,022 A * 8/2000 Landman et al. ..... 347/228
6,323,963 B1 * 11/2001 Takahashi ..... 358/474

FOREIGN PATENT DOCUMENTS

| | | |
|---|---|---|
| EP | 0 496 337 | 7/1992 |
| JP | 06-138805 | 5/1994 |
| JP | 08-339138 | 12/1996 |
| JP | 2000-127468 | 5/2000 |
| JP | 2001-138558 | 5/2001 |

* cited by examiner

*Primary Examiner*—Eugene H Eickholt
(74) *Attorney, Agent, or Firm*—Pillsbury Winthrop LLP

(57) ABSTRACT

A printing apparatus has a take-out shaft and a rolling-up shaft to supply an intermediate transfer ribbon provided with a transfer layer having a first area in a prescribed pattern and a blank and transparent second area, a printer portion to print prescribed data on the transfer layer of the supplied intermediate transfer ribbon, and a transfer portion to transferr the printed prescribed data on an image receiving medium (a passbook) 1 jointly with the transfer layer. The printer portion and the transfer portion are controlled independently in a first mode to cover the entire image receiving medium and in a second mode to cover the image receiving medium by the first area and the second areas.

31 Claims, 7 Drawing Sheets

FIG.6A
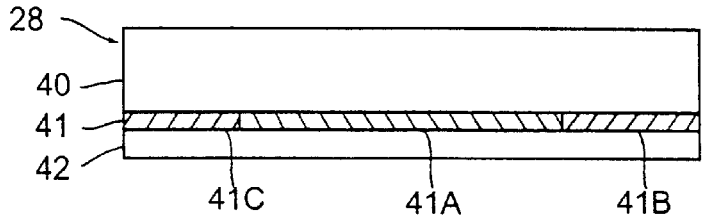
FIG.6B
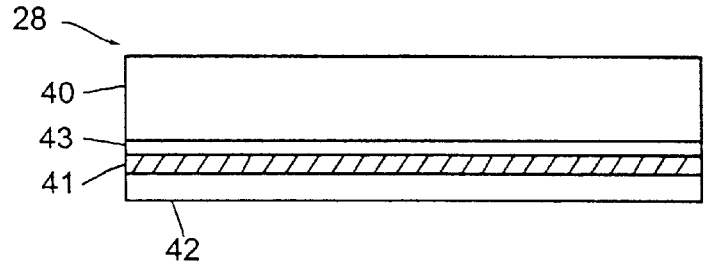
FIG.6C
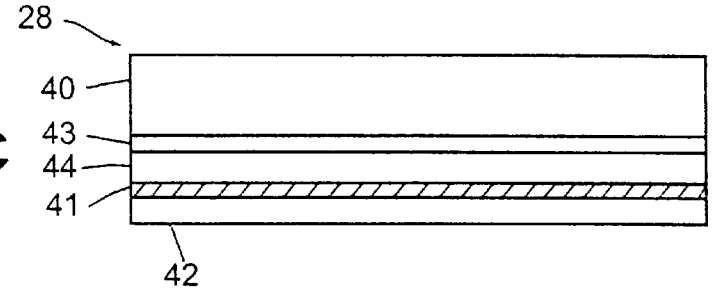
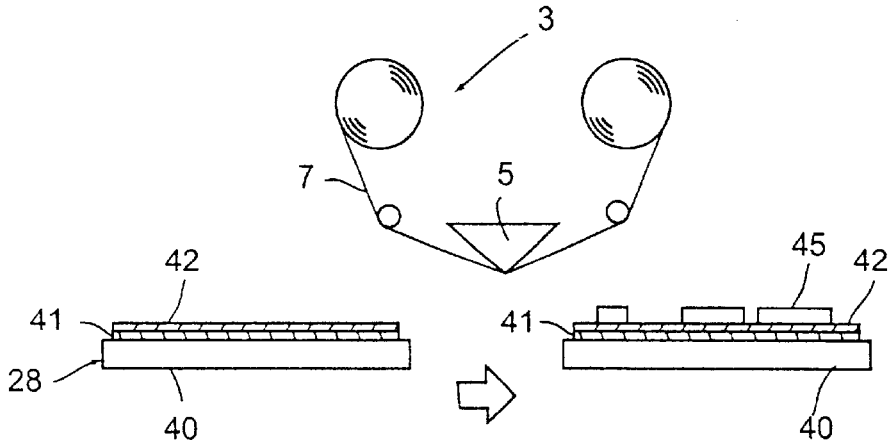
FIG.7

PRINTING APPARATUS AND PRINTING METHOD

CROSS-REFERENCE TO RELATED APPLICATIONS

This application is based upon and claims the benefit of priority from the prior Japanese Patent Application No. 2001-290255, filed on Sep. 21, 2001: the entire contents of which are incorporated herein by reference.

BACKGROUND OF THE INVENTION

This invention relates to a printing apparatus and a printing method and, more particularly, to a printing apparatus and a printing method for printing prescribed data on data receiving media such as passbooks and so forth.

A printing apparatus that performs the printing of high quality without affected by the surface condition of data receiving media such as cards, passbooks and other media is demanded in recent years. As one of this kind printing apparatus, a printing apparatus to use an intermediate transfer ribbon is well known. This type of printing apparatus comprises a printer portion and a transfer portion. The printer portion has a thermal head and an ink ribbon. The transfer portion has a heat roller and a back up roller.

The intermediate transfer ribbon is fed into the printer portion. In the printer portion, the thermal head is heated according to prescribed data and an ink of the ink ribbon is fused and prints prescribed data such as characters and bar codes on the surface of an intermediate transfer ribbon.

The intermediate transfer ribbon having prescribed data printed is fed between the heat roller and the back up roller in the transfer portion. At this time, an image receiving medium arranged to face its transfer surface to the intermediate transfer ribbon is simultaneously fed between the heat roller and the back up roller.

The heat roller is rotated in this state and the intermediate transfer ribbon and an image receiving medium are pushed against the back up roller and heated, and prescribed data are transferred on the surface of the image receiving medium. The intermediate transfer ribbon comprises a long base film and a transfer layer coated on this base film. In the transfer portion, the transfer layer is transferred on an image receiving medium together with prescribed data printed on the transfer layer.

On the transfer layer or an image receiving medium, prescribed data that are optically read may be printed sometimes. On the other hand, in order for preventing forgery of peculiar prescribed data on an image receiving medium, a protection film given with a transparent hologram in a specified pattern may be coated over an image receiving medium. The printing apparatus described above is capable of printing prescribed data on an image receiving medium and coating a surface protection film at the same time.

When reading prescribed data printed in a reading area of an image receiving medium that is coated with a protection film having the transparent hologram layer with an optical reading device, a prescribed pattern of a transparent hologram layer superposed on the prescribed data are read simultaneously and the prescribed data may not be read accurately or recognized in the image processing.

Further, data receiving media having the reading area and those having no reading area are supplied irregularly and therefore, it becomes difficult to overcoat the optimum protection film to these media, respectively. Further, if a protection film for an image receiving medium is coated over an image receiving medium having no reading area, prescribed data printed on the image receiving medium may not be covered partially by a prescribed pattern of a transparent hologram layer. As a result, there may be caused a problem that the sufficient forgery preventing effect may not be obtained.

BRIEF SUMMARY OF THE INVENTION

It is an object of this invention to provide a printing apparatus and a printing method capable of surely reading prescribed data printed in a reading area, obtaining a sufficient forgery preventing effect and performing a high quality printing stably irrespective of the surface conditions of data receiving media.

According to this invention, a printing apparatus is provided. This printing apparatus comprises: a supply portion to supply an intermediate transfer medium provided with a transfer layer having a first area that has a prescribed pattern and a blank and transparent second area; a printer portion to print prescribed data on the transfer layer of the intermediate transfer medium supplied from the supply portion; a transfer portion to transfer the prescribed data printed by the printer portion onto an image receiving medium through the transfer layer; and a controller to control the printer portion and the transfer portion in a first mode to cover the entire image receiving medium by the first area and a second mode to cover the image receiving medium by the first and second areas. Further, according to this invention, a printing method is provided.

This printing method comprises: supplying a transfer layer having a first area in a prescribed pattern and a plank and transparent second area; printing prescribed data on corresponding prescribed positions of the transfer layer of the supplied intermediate transfer medium in a first mode to cover the entire image receiving medium and in a second mode to cover the data transfer medium by the first and second areas; and transferring the prescribed data printed in the corresponding prescribed areas in the first mode and the second modes on the image receiving medium.

BRIEF DESCRIPTION OF THE DRAWINGS

FIGS. 6A through FIG. 6C are schematic sectional views showing the structure of the intermediate transfer ribbon that is applicable to the printing apparatus shown in FIG. 1, respectively;

FIG. 7 is a diagram for explaining the printing operation by the printer portion to print prescribed data on the intermediate transfer ribbon shown in FIG. 1;

DETAILED DESCRIPTION OF THE INVENTION

Figure 1:
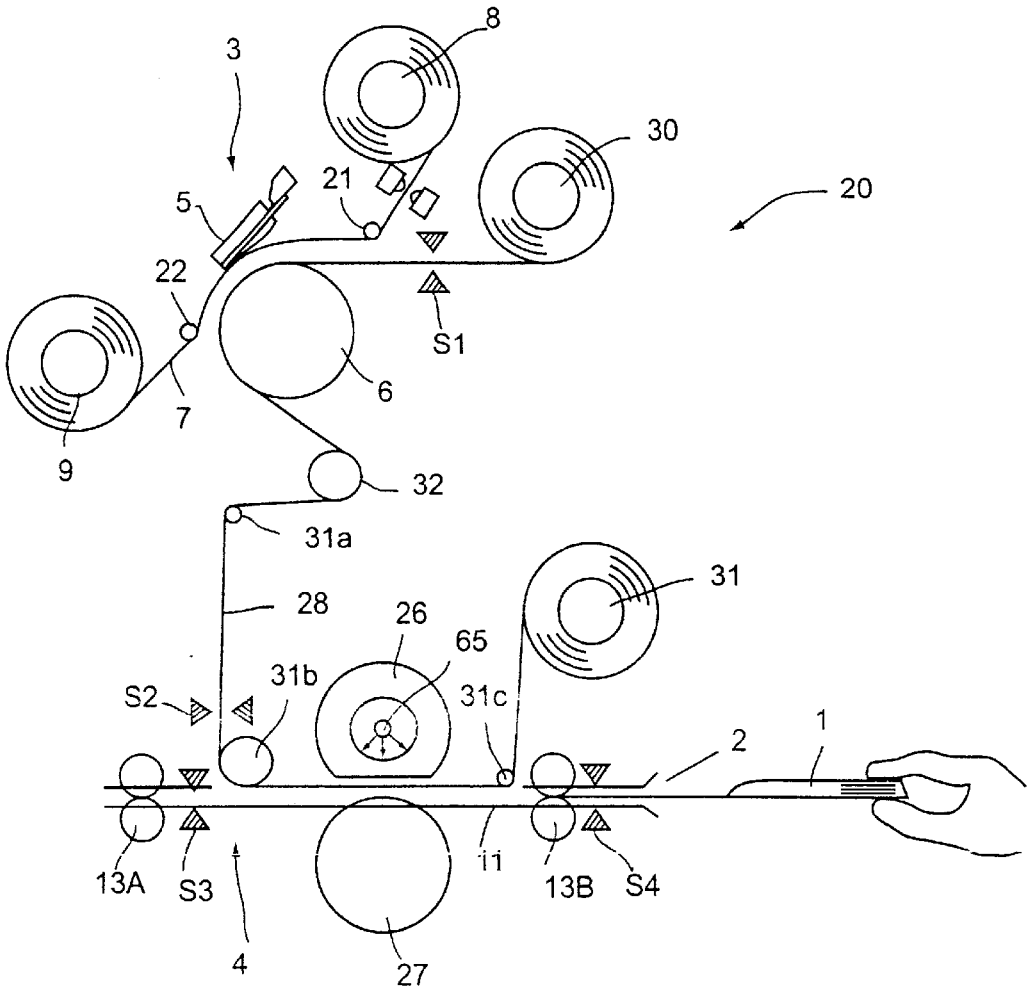
FIG. 1 is a schematic diagram showing the structure of a printing apparatus involved in an embodiment of this invention.

Hereinafter, a printing apparatus and a printing method involved in an embodiment of this invention will be explained referring to the drawings. This printing apparatus is an intermediate transfer type printing apparatus which executes the printing of prescribed data on data receiving media such as cards, passbooks and so forth, and providing a protection film on the printing surface at the same time.

As shown in FIG. 1, a printing apparatus 20 comprises a printer portion 3 which functions as a printing means and a transfer portion 4 which functions as a transferring means provided below the printer portion 3.

The printer portion 3 is provided with a platen roller 6, a thermal head 5 and other components that are arranged facing the thermal head 5. Between the thermal head 5 and the platen roller 6, there is an ink ribbon 7 having yellow (Y), magenta (M), cyan (C) and black (K) melting inks. The platen roller 6 functions as a supply means to supply an intermediate transfer ribbon 28 at a prescribed speed.

One end of the ink ribbon 7 is wound round a take-out shaft 8 and the other end is wound round a rolling-up shaft 9. At least either one of the take-out shaft 8 and the rolling-up shaft 9 can be driven independently in both the forward and reverse directions. The middle portion of the ink ribbon 7 taken out from the take-out shaft 8 is put over a guide shafts 21 and 22.

As the ink ribbon 7, a ribbon in a single color only is usable and ribbon materials may have such functions as a fluorescent pigment ink that becomes luminous when ultraviolet rays are applied, a glossy metallic thin film (aluminum vaporized) layer for printing or a hologram layer for printing.

The transfer portion 4 has a heat roller 26 as a transfer roller, a back up roller 26 arranged facing to the heat roller 26. Between the heat roller 26 and the back up roller 27, there is an intermediate transfer ribbon 28 that functions as an intermediate transfer medium.

One end of the intermediate transfer ribbon 28 is wound round the take-out shaft 30 provided at the upper side of the printer portion 3 and the other end is wound round the rolling-up shaft 31 provided at the lower side of the printer portion 3. At least either one of the take-out shaft 30 and the rolling-up shaft 31 can be driven independently in both the forward and reverse directions. Further, the take-out shaft 30 and the rolling-up shaft 31 function as a supply means to supply the intermediate transfer ribbon 28 toward the printer portion 3. The middle portion of the intermediate transfer ribbon 28 taken out from the take-out shaft 30 is put over guide shafts 31*a*–31*c* and also, put over a tension roller 32 and is maintained at almost a fixed tension.

Further, the transfer portion 4 is provided with a first conveying roller pair 13A and a second conveying roller pair 13B. The first conveying roller pair 13A is arranged at the upper stream side in the conveying direction from a heat roller 26. The second conveying roller pair 13B is arranged at the downstream side in the conveying direction from the heat roller 26.

The first and second conveying roller pairs 13A and 13B convey a passbook 1 that is inserted through the take-in port 2 as an image receiving medium with a printing page opened to a prescribed transferring position by the heat roller 26 along a conveying path 11. That is, these first and second conveying roller pairs 13A and 13B convey the passbook 1 so that the transfer start position on the printing page of the passbook 1 is aligned with the transfer position by the heat roller 26.

Further, the transfer portion 4 is provided with a first sensor S1 and a second sensor S2 which function as detecting means arranged along the supply path of the intermediate transfer ribbon 28. The first sensor S1 and the second sensor S2 output signals for detecting a bar mark arranged at the outside of an effective area of the intermediate transfer ribbon 28, which will be described later. Further, the transfer portion 4 is provided with a third sensor S3 and a fourth sensor S4 which function as detecting means arranged along the conveying path 11 of the passbook 1. The third sensor S3 and the fourth sensor S4 output signals for detecting the presence of the passbook 1 inserted through the take-in port 2.

Further, the first through the fourth sensors S1 through S4 are, for example, transmittance type sensors and equipped with a pair of light emitting portion and light receiving portion but they may be constructed by reflection type sensors.

Figure 2:
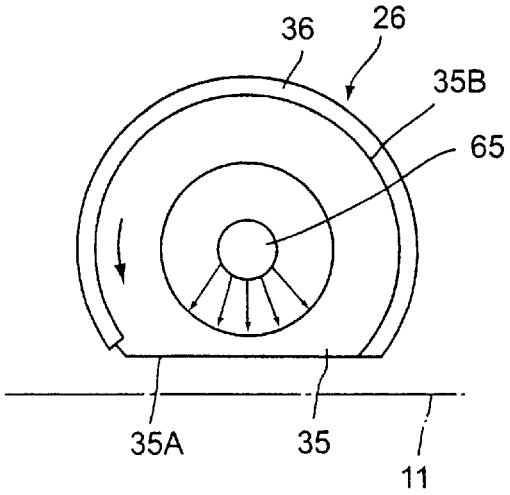
FIG. 2 is a schematic diagram showing the structure of a heat roller applied to the printing apparatus shown in FIG. 1.

The heat roller 26 has the almost semicircular section in the plane that is vertical to the rotating shaft as shown in FIG. 2. That is, the heat roller 26 has a core metal 35. This core metal 35 has a cut surface 35A that is cut to a plane shape on a part of its outer surface. In the inside of the core metal 35, a heater 65 is provided. The outer surface of an arc portion 35B of the core metal 35 is covered by a 1–2 mm thick heat resistance rubber 26.

Further, the heat resistance rubber 36 can be used to cover not only the arc portion 35B of the core metal 35 but also the whole outer surface including the cut surface 35A. In addition, the heat roller 26 may have the core metal only without the heat resistance rubber. In this case, it is desirable to apply the Teflon (the product name of du Pont) process to the surface of the heat roller to prevent adhesion of dirt. Further, the length of the heat roller 26 is formed in the length along the circumferential direction of the arc portion 35B almost equal to the length of the transfer area of the passbook 1.

The heat roller 26 is arranged almost in parallel with the conveying path 11 by facing the cut surface 35A to it as shown in FIG. 2. Thus, a clearance is formed between the heat roller 26 and the back up roller 27 to arrange the passbook 1. At this time, it is desirable to arrange the intermediate transfer ribbon 28 at a position where it does not contact the heat roller 26 and the back up roller 27 and also, the surface of the passbook 1 that is entering when the printing starts.

Figure 3:
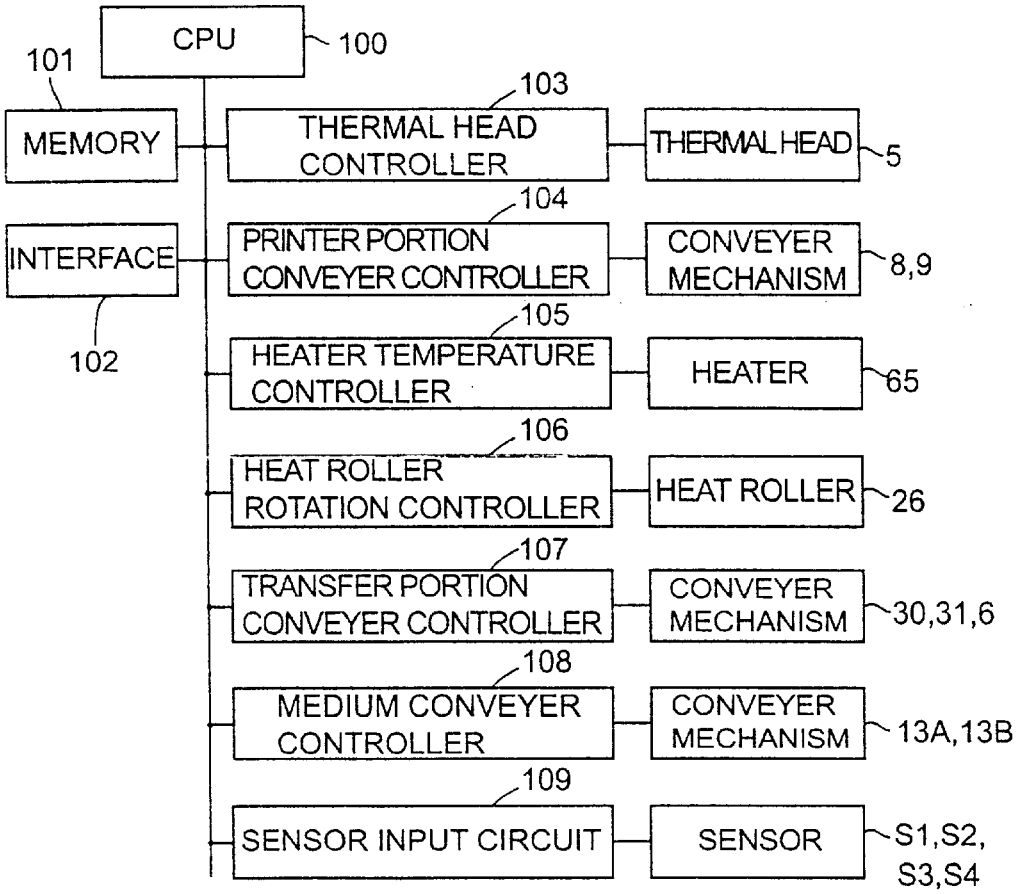
FIG. 3 is a schematic diagram showing the structure of a control system in the printing apparatus shown in FIG. 1.

The printing apparatus 20 is equipped with a CPU 100 that functions as a control means for controlling the entire apparatus as shown in FIG. 3.

The CPU 100 is connected with a memory 101 that stores a control program for controlling the operation of the entire apparatus, an interface 102 for receiving printing data required for printing from such external apparatus as a host computer and so forth. The printing data received through the interface 102 is tentatively stored in the memory 101.

Further, the CPU 100 is further connected with a thermal head controller 103, a printer portion conveyer controller 104, a heater temperature controller 105, a heat roller rotation controller 106, a transfer portion conveying controller 107, a medium conveying controller 108, and a sensor input circuit 109.

The thermal head controller 103 controls the printing operation of the thermal head 5 based on the printing data. The printer portion conveyer controller 104 controls the driving of the take-out shaft 8 and the rolling-up shaft which function as conveying mechanisms in the printer portion 3. The heater temperature controller 105 drives the heater 65 in the heat roller 26 so as to maintain the heat roller 26 at a specified temperature.

The heat roller rotation controller 106 controls the rotation and driving of the heat roller 26. That is, the heat roller rotation controller 106 transfers prescribed data on the intermediate transfer ribbon 28 on the passbook 1 by rotating the heat roller 26 in the prescribed direction after bringing the edge portion of the cut surface 35A of the heat roller 26 in contact with the transfer start position in the state with the transfer start position of an image receiving medium aligned with the transfer position of the prescribed data printed on the intermediate transfer ribbon 28 by the heat roller 26.

The transfer portion conveyer controller 107 controls the driving of the platen roller 6, the take-out shaft 30 and the rolling-up shaft 31 which function as the conveying mechanism in the transfer portion 4. The medium conveyer controller 108 controls the driving of the first and second conveying roller pairs 13A and 13B, takes in the passbook 1 from the take-in port 2 and conveys to the prescribed transfer position, and discharges the data transfer completed passbook 1 from the take-in port 2.

The sensor input circuit 109 detects the bar mark of the intermediate transfer ribbon 28 according to the signals output from the first sensor S1 and the second sensor S2. Further, the sensor input circuit 109 detects the presence of the passbook 1 based on the output signals from the third sensor S3 and the fourth sensor S4.

Next, the printing method that is applied to the printing apparatus described above; that is, the first printing mode and the second printing mode will be explained.

Figure 4B:
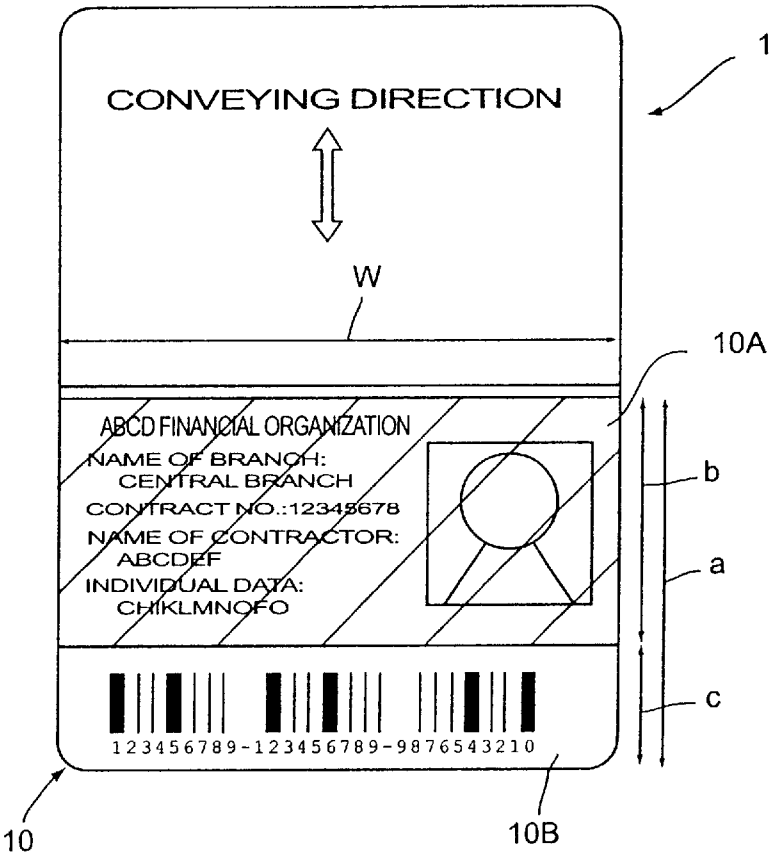
FIG. 4A and FIG. 4B are diagrams for explaining a first printing mode and a second printing mode that are applicable to the printing apparatus shown in FIG. 1.
Figure 4A:
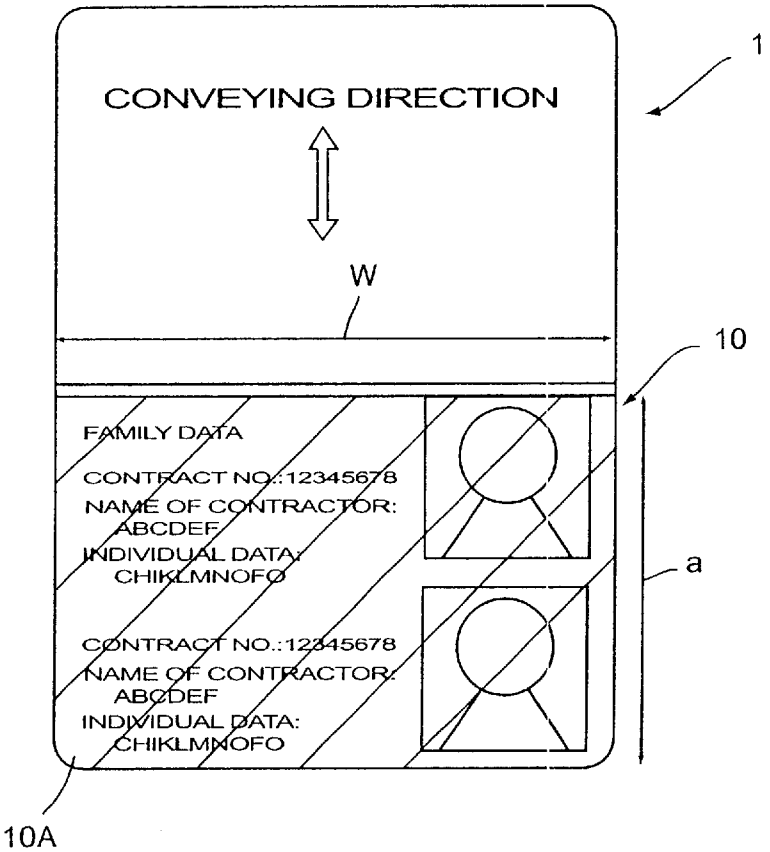

In the first printing mode, a protection film given with a transparent hologram layer in a prescribed pattern is coated over the entire passbook 1; for example, the printing area 10A of the whole surface of the printing page 10 of the passbook 1 as shown by the oblique lined portion in FIG. 4A.

That is, in the first printing mode, the protection film given with the transparent hologram layer is coated over the entire length a along the conveying direction of the printing page 10 and the entire width w along the direction orthogonal to the conveying direction, In the second printing mode, a blank and transparent protection film is coated over a part of an image receiving medium; for example, the reading area 10B of the passbook 1, which is optically read and a protection film given with a transparent hologram layer in a prescribed pattern is coated over the other portion of the image receiving medium; for example, the printing area 10A of the printing page 10 of the passbook 1 as shown in FIG. 4B.

That is, in this second printing mode, the protection film given with the transparent hologram layer is coated over the entire length b and width w along the conveying direction of the printing page 10 (the oblique lined portion). Further, the blank transparent protection film is coated over the entire length c (=a−b) and width w along the conveying direction of the printing page 10.

In the printing area 10A, such prescribed data as peculiar identification data and face image data are printed. In the reading area 10B, data codes (bar codes) which are coded peculiar identification data and face image data are printed. The reading area 10B is formed, for example, in a prescribed width provided at the lower end of the printing page 10.

In this embodiment, when a protection film is coated over the passbook 1 which has the printing area 10 formed on the whole surface of the printing page 10 as shown in FIG. 4A, the first printing mode is executed. Further, when a protection film is coated over the passbook 1 which has the printing area 10B formed in a part of the printing page 10 and the printing area 10A in the other portion as shown in FIG. 4B, the second printing mode is executed.

As described above, even when data receiving media with different arrangement conditions as in the printing area 10 and the printing area 10B are supplied irregularly, the optimum printing mode is judged for every supplied image receiving medium. By executing the first or second printing mode thus judged, it becomes possible to coat the optimum protection film over respective image receiving medium.

Therefore, data codes that are used, for example, mainly for reading by an optical reading apparatus and corresponding to prescribed data printed on the printing area 10A will not be read jointly with a specified pattern of a transparent hologram layer when read by an optical reading device. Accordingly, when reading data codes, it becomes possible to read data codes accurately and surely recognize.

In the case of an optical reading apparatus of such type to read the passbook 1 by moving its lower end where data codes are printed along an optical system, noises other than data will affect the reading rate. It is therefore effective to coat the reading area 10B from the lower end of the passbook 1 up to a fixed height with a blank transparent protection film entirely as in this embodiment.

On the other hand, either in the first printing mode or the second printing mode, the printing area 10A in the printing page 10 of the passbook 1 is coated by a protection film given with the transparent hologram layer in the prescribed pattern. Therefore, it becomes possible to get fully the forgery preventing effect of the printed prescribed data.

In the above embodiment, the bar codes as the data codes are printed in the reading area 10B. However, characters readable by OCR (Optical Character Reader) may be printed as the data codes in the reading area 10B.

Next the structure of the intermediate transfer ribbon that is applicable to the printing apparatus described above will be explained.

The intermediate transfer ribbon 28 is, for example, in three-layer structure as shown in FIG. 6A. That is, this ribbon is composed of a base layer 40, a hologram layer 41 provided on the base layer 40, and an adhesion layer 42 that is arranged on the hologram layer 41 and functions as an image receiving layer. On the adhesion layer 42, prescribed data is printed by the printer portion 3.

Of three layers of the intermediate transfer ribbon 28, the hologram layer 41 and the adhesion layer 42 function as transfer layers and are transferred on the passbook 1 jointly with the prescribed data printed on the adhesion layer 42 in the transfer portion 4. The hologram layer 41 that is arranged on the top layer when transferred on the passbook 1 functions as a protection film.

The intermediate transfer ribbon 28 is not restricted to the structure shown in FIG. 6A but can be in a structure with a separation layer 43 provided between the base layer 40 and the hologram layer 41 as shown in FIG. 6B. In this structure, a separation layer 43, the hologram layer 41 and the adhesion layer 42 function as the transfer layers.

The intermediate transfer ribbon 28 may be in such a structure that the separation layer 43, a protection layer 44, the hologram layer 41, and the adhesion layer 42 are laminated in this order on the base layer 40. In the case of such structure, the separation layer 43, the protection layer 44, the hologram layer 41, and the adhesion layer 42 function as the transfer layers.

Figure 5:
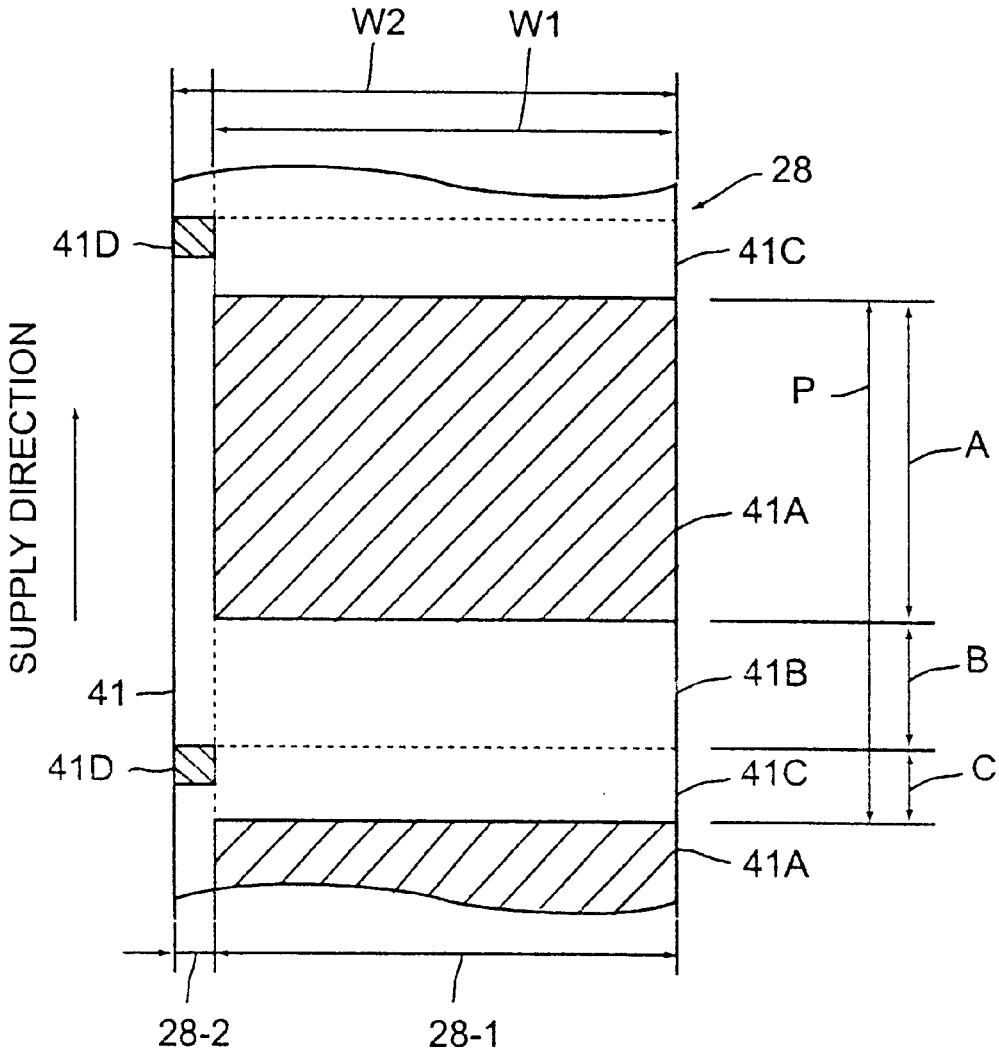
FIG. 5 is a schematic plan view showing the structure of an intermediate transfer ribbon that is applied to the printing apparatus shown in FIG. 1.

The hologram layer 41 of the intermediate transfer ribbon 28 has the first area 41A comprising a transparent hologram layer in a prescribed pattern, the blank transparent second area 41B, and the third area 41C that is equivalent to a margin as shown in FIGS. 5 and 6A. The first area 41A, the second area 41B, and the third area 41C are arranged in order along the supply direction of the intermediate transfer ribbon 28 and form a unit pattern.

Further, the hologram layer 41 of the intermediate transfer ribbon 28 has a bar mark 41D defining a unit pattern comprising the first area 41A, the second area 41B, and the third area 41C. This bar mark 41D is provided in the area 28-2 outside the effective area 28-1 of the intermediate transfer ribbon 28.

That is, the first area 41A of the hologram layer 41 is an area having the diffraction effect to diffract the incident light from the prescribed first direction in the second direction. As a pattern itself, for example, a character, picture, logo and so forth can be freely designed; however, when a printed data forgery preventing effect is taken into consideration, it is desirable that a pattern is formed on the whole surface as could as possible.

The second area 41B has no effect to diffract rays of light in the visible light area and its neighboring frequency band in the hologram layer 41 and is a visible almost transparent area. The third area 41C is an area equivalent to a margin taking the shift of a transfer position into consideration and a visually almost transparent area having no diffraction effect likewise the second area 41B.

The bar mark 41D is arranged repeatedly for every unit pattern and has a prescribed pattern having the diffraction effect. This bar mark 41D is detected by the first sensor S1 and the second sensor S2. That is, the printing apparatus is able to detect the position of the intermediate transfer ribbon 28 by detecting this bar mark 41D.

Further, the bar mark 41D is arranged in the area 28-2 outside the effective area 28-1. That is, the outside area 28-2 is a visually almost transparent area having no diffraction effect and is not arrange in any other place than the bar mark 41D along the supply direction of the intermediate transfer ribbon 28. Therefore, the printing apparatus is enabled to surely detect the bar mark 41D based on the output signals from the first sensor S1 and the second sensor S2 arranged to face the outside area 28-2 of the intermediate transfer ribbon 28.

A unit pattern comprising the first area 41A, the second area 41B, and the third area 41C is arrange at a pitch P along the supply direction of the intermediate transfer ribbon 28 as shown in FIG. 5.

The first area 41A is formed in a rectangular shape extending over the length A and the width W1 of the effective area 28-1 along the supply direction. The first area 41A has the length A slightly longer than the length a of the conveying direction of the printing area 10A in the passbook 1 equivalent to the maximum transfer length.

That is, the length A of the first area 41A is longer than the length a required for transfer to the printing area 10A of the passbook 1 in the first transfer mode. As a matter of course, the length of the first area 41A is longer than the length b (<a) required for the transfer to the printing area 10A of the passbook 1 in the second printing mode. Further, the width W1 of the first area 41A has a length almost equal to or longer than the width w of the passbook.

The second area 41B is formed in a rectangular shape extending over the length B along the supply direction and the width W of the intermediate transfer ribbon 28. The second area 41B has the length B that is slightly longer than the length c in the conveying direction of the reading area 10B in the passbook 1 equivalent to the maximum transfer length. Further, the width W2 of the second area 41B is longer than the width w of the passbook.

The third area 41C is formed in a rectangular shape extending over the length C along the supply direction and the width W1 of the effective area 28-1. At this time, $$P=A+B+C(C>0)$$

and preferably, the length C of the third area 41 is set in the range of 5–50 mm.

In the first and second printing modes, it becomes possible to surely cover the printing area 10A of the passbook 1 by the protection film given with the hologram layer 41 in the prescribed pattern when the length A and the width W1 are set up as described above.

Further, in the second printing mode, it becomes possible to surely cover the reading area 10B of the passbook 1 by the blank and transparent protection film when the length B and the width W2 of the second area 41B are set up as described above. Further, when the length C and the width W1 of the third area 41C which is a margin are set up as described above, even if the transfer position, etc. were shifted, it becomes possible to surely cover the printing area 10A by the first area 41A and the reading area 10B by the second area 41B.

Next, the printing operation to the intermediate transfer ribbon 28 by the printer portion 3 of the printing apparatus will be explained.

The CPU 100 of the printing apparatus judges whether the printing should be made in either the first printing mode or the second printing mode according to the received printing start direction. At this time, the CPU 100 judges the printing mode according to, for example, data received jointly with the printing start direction, printing data stored in a memory 101 and data relative to the printing page 10 of the passbook 1 inserted through the take-in port 2.

In succession, the CPU 100 controls a transfer portion conveyer controller 107, drives the platen roller 6, the take-out shaft 30 and the rolling-up shaft 31 that comprise the conveying mechanism, and sends out the intermediate transfer ribbon 28. Then, the CPU 100 detects the bar mark 41D of the intermediate transfer ribbon 28 according to the signal that is output from the first sensor S1 through a sensor input circuit 109.

Then, the CPU 100 calculates a sending amount of the intermediate transfer ribbon 29 from a reference position of the bar mark 41D based on the printing data and the printing mode using the detected position of the bar mark 41D. That is, the CPU 100 calculates an amount of the intermediate transfer ribbon 28 taken out from the position of the bar mark 41D detected at the first sensor S1 to the print start position by the thermal head 5 at which the specified position of the first area 41A or the second area 41B of the hologram layer 41 arrives.

In succession, the CPU 100 controls the transfer portion conveyer controller 107 based on the calculated sending amount of the ribbon, drives the platen roller 6, the take-out shaft 30 and the rolling-up shaft 31, sends the intermediate transfer ribbon 29 by a prescribed sending amount to move the prescribed printing position of the first area 41A or the second area 41B to the print start position by the thermal head 5.

In succession, the CPU 100 controls a thermal head controller 103 based on the printing data, drives the thermal head 5 and prints color or black prescribed data by transferring inks of the ink ribbon 7 on the adhesion layer 42 as shown in FIG. 7. That is, thermal head 5 is heated based on the printing data and the inks of the ink ribbon 7 are melted and transferred on the surface of the adhesion layer 42 of the intermediate transfer ribbon 28.

That is, in the first printing mode, the CPU 100 controls the position of the intermediate transfer ribbon 28 so as to start the printing operation to the intermediate transfer ribbon 28 in the printer portion 3 from the printing position on the adhesion layer 42 corresponding to a point close to the end portion of the first area 41A and does never print prescribed data on the adhesion layer 42 corresponding to the second area 41B.

Further, in the second printing mode, the CPU 100 controls the position of the intermediate transfer ribbon 28 so as to start the printing operation from the printing position on the adhesion layer 42 corresponding to the point close to the middle portion of the first area 41A and when necessary, prints prescribed data, for example, a bar code on the adhesion layer 42 corresponding to the second area 41B.

Prescribed data can be printed in a single color such as black or multi-colors of yellow, magenta, cyan and black colors superposed. When necessary, a single color ink ribbon or multi-colors ink ribbons can be coated repeatedly. Further, a fused black ink may be used for printing characters, and yellow, magenta, cyan and black sublimation dyes can be coated repeatedly for the color printing. In the case of the multi-color superposing printing, the printing is made by moving the intermediate transfer ribbon 28 to and from the thermal head 5 by the same number of times as the number of colors. The intermediate transfer ribbon 28 is conveyed after the conveying speed is determined mainly by the platen roller 6 and therefore, the platen roller 6 is accurately driven in combination of a 5-phase stepping motor with a reduction mechanism. Further, prescribed data to be printed has a feature that the data is a reversed image.

Next, the transfer operation of prescribed data to the passbook 1 by the transfer portion 4 of the printing apparatus will be explained. In this embodiment, the adhesion layer 42 of the intermediate transfer ribbon 28 that has the prescribed data printed in the printer portion 3 is put over the applicable printing page 10 of the passbook 1, and the adhesion layer 42 and the hologram layer 341 are transferred at the same time on the passbook 1 jointly with the prescribed data.

Figure 8A:
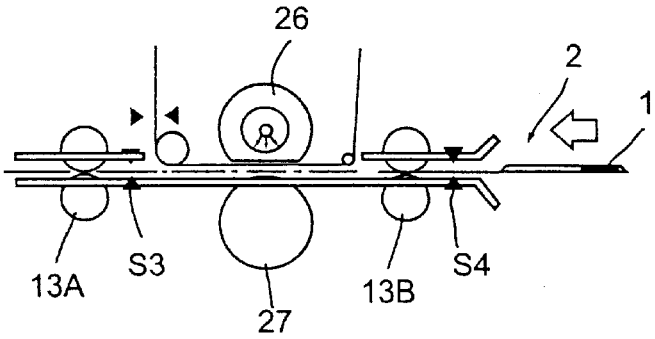
FIGS. 8A through FIG. 8D are diagrams for explaining the transfer operation by the transfer portion to transfer prescribed data on the intermediate transfer ribbon on an image receiving medium shown in FIG. 1.

That is, as shown in FIG. 8A, when the passbook 1 is inserted into the take-in port 2, the fourth sensor S4 senses the insertion of the passbook 1 and the CPU 100 of the printing apparatus 20 inputs the output signal from the sensor S4 into the sensor input circuit 109. The sensor input circuit 109 into which the output signal from the fourth sensor S4 is input controls the media conveyer controller 108. The media conveyer controller 108 drives the second conveying roller pair 13B and the first conveying roller pair 13A. that are the conveying mechanism, conveys the passbook 1 with the printing page 10 opened to the transfer position.

Figure 8B:
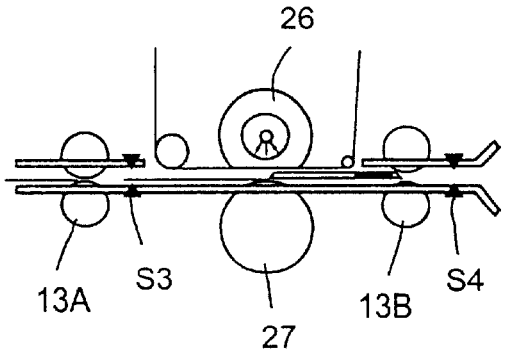

In succession, as shown in FIG. 8B, when the third sensor S3 detects the end portion of the passbook 1, the CPU 100 of the printing apparatus 20 inputs the output signal from the third sensor S3 into the sensor input circuit 109. When the output signal is input, the sensor input circuit 109 controls the media conveyer controller 108. The media conveyer controller 108 once stops to drive the first conveying roller pair 13A and the second conveying roller pair 13B.

Then, the CPU 100 controls the media conveyer controller 108 to align the transfer start position on the passbook 1 with the transfer position in the transfer portion 4 based on the printing data and the printing mode. The media conveyer controller 108 finely adjusts the position of the passbook 1 by the first conveying roller pair 13A and the second conveying roller pair 13B. That is, the passbook 1 is positioned so that the edge portion of the cut surface 35A of the heat roller 26 is brought in contact with a portion close to the seam of the printing page 10.

On the other hand, the CPU 100 judges whether the first printing mode or the second printing mode should be executed based on the received print start direction.

Then, the CPU 100 drives the platen roller 6, the take-out shaft 30 and the rolling-up shaft 31 by controlling the transfer portion conveyer controller 107 and sends out the intermediate transfer ribbon having the prescribed data printed in the printer portion 3. Then, the CPU 100 detects the bar mark 41D of the intermediate transfer ribbon 28 that is sent out according to the output signal from the second sensor S2 via the sensor input circuit 109.

In succession, using the position of the detected bar mark 41D as the reference, the CPU 100 calculates an take-out amount of the intermediate transfer ribbon 28 from the reference position of the bar mark 41D according to the printing data and the printing mode. That is, the CPU 100 calculates the take-out amount of the intermediate transfer ribbon 28 from the position wherein the bar mark 41D was detected by the second sensor S2 to the transfer position of the heat roller 26 at which the prescribed position of the first area 41A or the second area 41B arrives in the hologram layer 41.

In succession, the CPU 100 drives the platen roller 6, the take-out shaft 30 and the rolling-up shaft 31 by controlling the transfer portion conveyer controller 107 based on the calculated take-out amount, takes out the intermediate transfer ribbon 28 by the prescribed take-out amount and have the prescribed printing position of the first area 41A or the second area 41B arrive at the transfer position in the transfer portion 4.

Figure 8C:
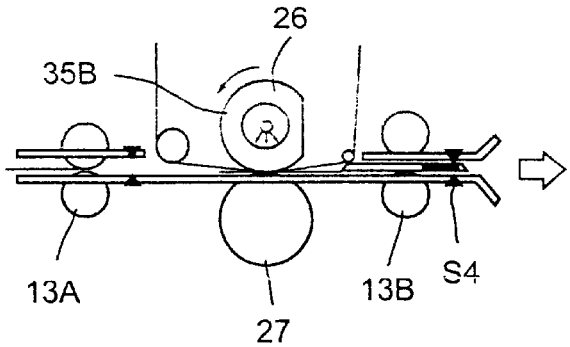

Then, the CPU 100 drives the heater 65 by controlling the heater temperature controller 105 and heats the heat roller 26 to a prescribed temperature as shown in FIG. 8*c*. Then, the CPU 100 rotates the heat roller 26 by controlling a heat roller rotation controller 106 at a prescribed timing.

That is, the intermediate transfer ribbon 28 and the passbook 1 are superposed each other jointly with the rotation of the heat roller 26 that has the cut surface 35A that is partially cut on the circumference. At this time, the transfer is started with the ribbon and the passbook superposed each other so that the seamed portion of the printing page 10 of the passbook 1 becomes in parallel to the cross direction orthogonal to the supply direction of the intermediate transfer ribbon 28.

At the same time, the passbook 1 is conveyed by the conveying roller pair 13A and 13B and the intermediate transfer ribbon 28 is conveyed by the take-in shaft 30, the rolling-up shaft 31 and the platen roller 6. At this time, both the intermediate transfer ribbon 28 and the passbook 1 are heated under pressure.

Thus, the prescribed data printed adhesion layer 42 and the hologram layer 41 are transferred on the printing surface 10 of the passbook 1. Further, in this embodiment the heat roller 26 can be driven at a more accurate fixed speed using a DC servo motor or a stepping motor and the pressure generated by a coil spring is applied between the heat roller 26 and the freely rotating back up roller.

This transfer process is explained more in detail. The CPU 100 controls the position of the intermediate transfer ribbon 28 in the first printing mode so that the transfer operation to the intermediate transfer ribbon 28 is started from the position close to the top portion of the first area 41A in the transfer portion 4. Then, only the first area 41A in the hologram layer 41 of the intermediate transfer ribbon 28 is press fit on the printing page 10 of the passbook 1 by the arc portion 35B of the heat roller 26. That is, the second area 41B in the hologram layer 41 of he intermediate transfer ribbon 28 is not positioned on the arc portion 35B. As a result, the first area 41A of the hologram layer 41, the adhesion layer 42 and the prescribed data printed on the adhesion layer 42 are transferred on the printing page 10 of the passbook 1.

In the second printing mode, the CPU 100 controls the position of the intermediate transfer ribbon 28 so that the transfer operation is started from the position close to the middle portion of the first area 41A. Then, the first area 41A and the second area 41B of the hologram layer 41 of the intermediate transfer ribbon 28 are press fit on the printing page 10 of the passbook 1 by the arc portion 35B of the heat roller 26. Thus, the first and second areas 41A and 41B of the hologram layer 41, the adhesion layer 42, and the prescribed data printed on the adhesion layer 42 are transferred on the printing page 10 of the passbook 1.

Figure 8D:
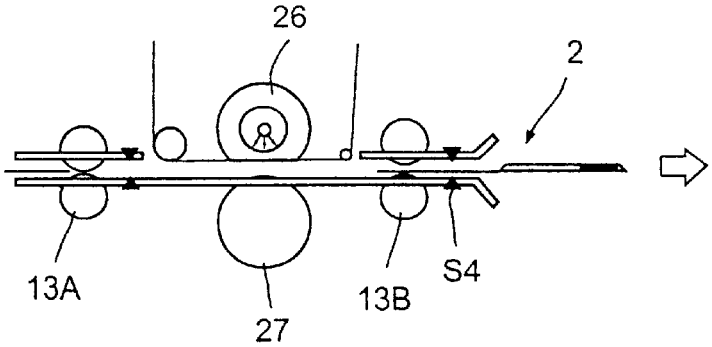

In succession, the CPU 100 drives the first conveying roller pair 13A and the second conveying roller pair 13B by controlling the media conveyer controller 108, and discharges the transfer completed passbook 1 from the take-in port 2 as shown in FIG. 8D.

By the printing operation and the transfer operation described above, it becomes possible to print prescribed data on the printing page 10 of the passbook 1 and cover the whole surface of the printing area 10A with peculiar prescribed data printed by a protection film that has the diffraction effect and the whole surface of the reading area 10B printed with optically readable prescribed data by a protection film that has no diffraction effect.

Next, the printing system equipped with the printing apparatus described above will be explained.

Figure 9:
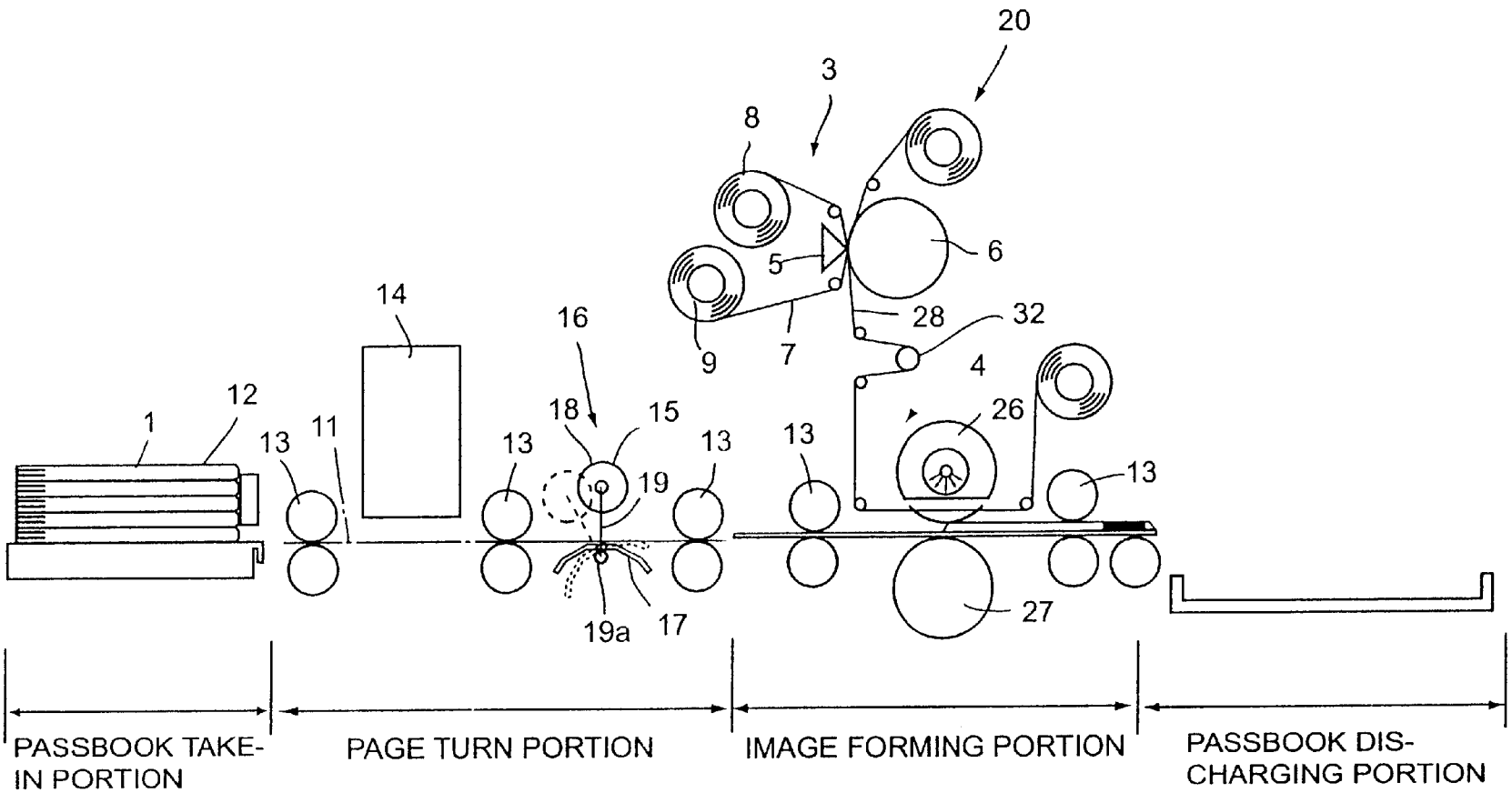
FIG. 9 is a schematic diagram showing the structure of the printing system.

That is, this printing system has a passbook take-in portion 12 that houses received plural closed passbooks 1 in the stacked state and takes in the passbook one by one and a conveying path 11 extending in the right direction in FIG. 9 from this passbook take-in portion 12 as shown in FIG. 9. On the conveying path 11, there are provided plural conveying roller pair 13 . . . for conveying the passbooks 1 taken in from the passbook take-in portion 12 in both the forward and reverse directions. In the following explanation, the right direction from the passbook take-in portion 12 toward the printing apparatus in FIG. 9 is regarded as the forward direction and the opposite direction as the reverse direction.

Further, this printing system is provided with a page detecting sensor 14 for detecting the opened printing page 10 of the passbook 1 that is an image receiving medium, a page turn over portion 16 having a page turn over mechanism 15, and the printing apparatus 20 that prints prescribed data on the passbook 1 with a prescribed page opened by the page turn over portion 16 along the conveying path 11. The printing apparatus 20 is in the same structure of the printing apparatus 20 described above and therefore, the detailed explanation thereof will be omitted here.

The page detecting sensor 14 detects an image on the opened printing page of the passbook 1, reads a bar code (not shown) given to a prescribed position of that page based on its image data and recognizes the opened page of the passbook 1.

The page turn over mechanism 15 has a back up plate 17 provided below the conveying path 11, a turn over roller 18 provided above the conveying path 11 and a swing shaft 19 that rotates freely centering around a fulcrum 19*a* provided to the back up plate 17 and is mounted with the turn over roller 18 rotatably at its swing end. When the swing shaft 19 is swung by a motor (not shown) to a position shown by the broken line in FIG. 9, the turn over roller 18 is swung and the back up plate 17 is also swung in conjunction with the turn over roller 18. Further, the turn over roller 18 can be rotated clockwise or counterclockwise by a motor (not shown).

When the page of the passbook 1 is turned over by the page turn over mechanism 15, the passbook 1 is first conveyed to a prescribed position in the page turn over mechanism 15 and stopped there and then, for example, the swing shaft 19 is swung leftward as shown by the broken line in FIG. 9, and the turn over roller 18 is pushed against the passbook 1. At this time, the back up plate 17 is also swung accompanied with the swing of the swing shaft 19 and the back surface of the passbook 1 is pushed upward by the inclined back up plate 17.

Under this state, the turn over roller 18 pushed against a page at the upper stream side in the conveying direction of the passbook 1 is rotated and the turn over operation of the top page of the passbook 1 is started. By this turn over operation, the applicable page is swelled as if pushed up and the turn over roller 18 is stopped when the page is turned over to the some extent. Further, after the swing shaft 19 is moved back to the position shown by the solid line in FIG. 9 from this state, the turn over roller 18 is rotated again and the said page is completely turned over on the turn over roller 18.

Then, the passbook 1 is conveyed in the reverse direction, the turned over page on the turn over roller is opened, image data on the opened page is detected by the page detecting sensor 14 and further, by reading a bar code, the opened page is confirmed. As a result, it becomes possible to open a desired page of the passbook 1 automatically and confirm the opened page. Thus, the passbook 1 of which kind is recognized and desired page is opened is conveyed to the printing apparatus 20 wherein prescribed data is printed and a protection film is transferred on its surface.

Further, by operating the operation described above in the reverse order, it is possible to open pages of the passbook 1 in the reverse direction.

The passbook 1 having prescribed data printed in the printing apparatus 20 is further conveyed toward the downstream side in the conveying direction and discharged into a passbook receiving portion.

According to such a printing system described above, it becomes possible to automatically prepare the passbook 1 having printed prescribed data continuously.

As explained above, according to this printing apparatus and the printing method, by printing prescribed data on the image layer (the adhesion layer) of the intermediate transfer medium and transferring the adhesion layer jointly with the prescribed data on an image receiving medium, it becomes possible to make the high quality printing stably without affected by the surface condition of an image receiving medium.

Further, even when data receiving media having different arranging conditions of the printing area having peculiar prescribed data printed and the reading area having optically readable prescribed data printed are supplied irregularly, the optimum printing mode is judged for every supplied image receiving medium.

Then, when it is judged that an image receiving medium of which whole surface is the printing area, a first printing mode is executed to cover the whole surface of the printing area by a protection film having the diffraction effect after printing peculiar prescribed data in the printing area of an image receiving medium. Further, when it is judged that an image receiving medium a part of which is a reading area and the remainder is the printing area is supplied, a second printing mode is executed. The second printing mode is to cover the printing area by a protection film having the diffraction effect after printing prescribed data in the printing area and the reading area as necessary and cover the reading area by a protection film having no diffraction effect.

As a result, it becomes possible to coat the optimum protection film on respective data receiving media. Therefore, when reading the reading area by an optical reading device, it is possible to accurately read data codes of the reading area and recognize data certainly.

Further, in the first and second printing modes, all of the printing areas of data receiving media are coated with a protection film given with a transparent hologram layer in a prescribed pattern having the diffraction effect. Therefore, it becomes possible to get forgery preventing effect of printed prescribed data sufficiently.

As explained above, this invention is able to provide a printing apparatus and a printing method capable of reading prescribed data printed in the reading area surely, obtaining the sufficient forgery preventing effect and executing the high quality printing stably irrespective of the surface conditions of data receiving media.

What is claimed is:

1. A printing apparatus comprising:

a supply portion to supply an intermediate transfer medium provided with a transfer layer having a first area that has a prescribed pattern and a blank and transparent second area;

a printer portion to print prescribed data on the transfer layer of the intermediate transfer medium supplied from the supply portion;

a transfer portion to transfer the prescribed data printed by the printer portion onto an image receiving medium through the transfer layer; and a controller to control the printer portion and the transfer portion in a first mode to cover the entire image receiving medium by the first area and a second mode to cover the image receiving medium by the first and second areas.

2. The printing apparatus according to claim 1, wherein the controller controls the printer portion so as to print prescribed data in the first area only in the first mode to cover the entire image receiving medium by the first area, and to print prescribed data corresponding to the first area and the second area in the second mode to cover the image receiving medium by the first and second areas.

3. The printing apparatus according to claim 1, wherein the controller controls the transfer portion so as to transfer the first area only in the first mode to cover the entire image receiving medium by the first area, and transfer the first area and the second area to corresponding areas in the second mode to cover the image receiving medium by the first area and the second area.

4. The printing apparatus according to claim 1, wherein the transfer layer of the intermediate transfer medium supplied by the supply portion has a mark defining a unit pattern comprising a third area that is equivalent to a margin and the first through the third areas, and further comprising:

a sensor to detect the mark;

wherein the controller further controls a supply amount of the intermediate transfer medium by the supply portion in the first mode to cover the entire image receiving medium by the first area and in the second mode to cover the image receiving medium by the first area and the second area based on the position of the mark detected by the sensor.

5. The printing apparatus according to claim 1, wherein the first area and the second areas are arranged along the supply direction of the intermediate transfer medium, and the first area has a sufficient length required for the transfer to the image receiving medium in the first mode.

6. The printing apparatus according to claim 1, wherein prescribed data that are optically read are printed in the second area.

7. The printing apparatus according to claim 1, wherein the first area has the length in the cross direction that is orthogonal to the supply direction of the intermediate transfer medium is almost equal to the length in the cross direction of the image receiving medium, and the second area has the length in the cross direction longer than the length in the cross direction of the image receiving medium.

8. The printing apparatus according to claim 1, wherein the image receiving medium is a passbook with a prescribed printing page opened.

9. The printing apparatus according to claim 8, wherein the transfer portion starts the transfer by superposing the intermediate transfer medium over the passbook so that a seamed portion of the printing page of the passbook becomes in parallel with the cross direction that is orthogonal to the supply direction of the intermediate medium.

10. The printing apparatus according to claim 1, wherein the transfer portion has a transfer roller having a partially cut plane surface on the outer surface.

11. The printing apparatus according to claim 10, wherein the transfer roller starts the transfer by bringing an edge portion of the cut surface in contact with a portion close to the seam of an opened prescribed printing page of the image receiving medium.

12. A printing apparatus comprising:

a supply portion to supply an intermediate transfer medium provided with a transfer layer having a first area in a prescribed pattern, a blank and transparent second area, a third area that is equivalent to the margin and a mark defining a unit pattern comprising the first through the third areas;

a printer portion to print prescribed data from a print start position on the transfer layer of the intermediate transfer medium supplied from the supply portion;

a sensor to detect the mark; and a controller to control a supply amount of the intermediate transfer medium by the supply portion up to the print start position by the printer portion in a first mode to cover the entire image receiving medium by the first area and the second mode to cover the image receiving medium by the first area and the second area.

13. The printing apparatus according to claim 12, wherein the first are and the second area are arranged along the supply direction of the intermediate transfer medium, and the first area has a sufficient length required for the transfer to the image receiving medium in the first mode.

14. The printing apparatus according to claim 12, wherein prescribed data that are optically read are printed in the second area.

15. The printing apparatus according to claim 12, wherein the first area has a length in the cross direction that is orthogonal to the supply direction of an intermediate medium almost equal to the cross directional length of an image receiving medium, and the second area has a length in the cross direction longer than the length in the cross direction of the image receiving medium.

16. The printing apparatus according to claim 12, wherein the image receiving medium is a passbook with its prescribed printing page opened.

17. The printing apparatus according to claim 16, wherein the transfer portion starts the transfer by superposing the intermediate transfer medium over the passbook so that a seamed portion of the printing page of the passbook comes in parallel with the cross direction orthogonal to the supply direction of the intermediate transfer medium.

18. A printing apparatus comprising:

a supply portion to supply an intermediate transfer medium provided with a transfer layer having a first area in a prescribed pattern, a blank and transparent second area, a third area that is equivalent to a margin, and a mark defining a unit pattern comprising the first through third areas;

a transfer portion to transfer the transfer layer of the intermediate transfer medium supplied from the supply portion on an image receiving medium at a transfer position jointly with printing data on the transfer layer;

a sensor to detect the mark; and a controller to control a supply amount of the intermediate transfer medium by the supply portion up to the transfer position based on the position of the mark detected by the sensor in a first mode to cover the entire image receiving medium by the first area and in a second mode to cover the image receiving medium by the first and second areas.

19. The printing apparatus according to claim 18, wherein the first area and the second area are arranged along the supply direction of the intermediate transfer medium, and the first area has a sufficient length required for the transfer to the image receiving medium in the first mode along its supply direction.

20. The printing apparatus according to claim 18, wherein the second area has prescribed data that are optically read are printed.

21. The printing apparatus according to claim 18, wherein the first area has a length in the cross direction that is orthogonal to the supply direction of an intermediate transfer medium almost equal to a length in the cross direction of an image receiving medium, and the second area has a length in the cross direction longer than a length in the cross direction of an image receiving medium.

22. The printing apparatus according to claim 18, wherein the image receiving medium is a passbook with a prescribed page opened.

23. The printing apparatus according to claim 22, wherein the transfer portion starts the transfer by superposing the intermediate transfer medium over the passbook so that a seamed portion of the printing page of the passbook becomes in parallel with the cross direction that is orthogonal to the supply direction of the intermediate medium.

24. The printing apparatus according to claim 18, wherein the transfer portion has a transfer roller having a partially cut plane surface on its outer surface.

25. The printing apparatus according to claim 24, wherein the transfer roller starts the transfer by bringing an edge portion of the cut surface in contact with a point near the seamed portion of the opened printing page of the image receiving medium.

26. A printing method comprising:

supplying a transfer layer having a first area in a prescribed pattern and a blank and transparent second area;

printing prescribed data on corresponding prescribed positions of the transfer layer of the supplied intermediate transfer medium in a first mode to cover the entire image receiving medium and in a second mode to cover the data transfer medium by the first and second areas; and transferring the prescribed data printed in the corresponding prescribed areas in the first mode and the second modes on the image receiving medium.

27. A printing method comprising:

supplying an intermediate transfer medium provided with a transfer layer having a first area in a prescribed pattern and a blank transparent second area;

printing prescribed data only on the first area of the supplied intermediate transfer medium in a first mode to cover the entire transfer medium by the first area; and printing corresponding prescribed data on the first area and the second area of the supplied intermediate transfer medium in a second mode to cover an image receiving medium by the first area and the second area.

28. A printing method comprising:

supplying an intermediate transfer medium provided with a transfer layer having a first area in a prescribed pattern and a blank and transparent second area;

transferring the first area of the supplied intermediate transfer medium on an image receiving medium jointly with printed data on the first area in a first mode to cover the entire image receiving medium; and transferring the first area and the second area of the supplied intermediate transfer medium on an image receiving medium jointly with the printed data on the first area and the second area in a second mode to cover the image receiving medium by the first area and the second area.

29. A printing method comprising:

supplying an intermediate transfer medium provided with a transfer layer having a first area in a prescribed pattern, a blank and transparent second area, a third area that is equivalent to a margin, and a mark defining an unit pattern comprising the first through the third areas;

detecting the mark;

controlling a supply amount of the intermediate transfer medium in a first mode to cover the entire image receiving medium and a second mode to cover the image receiving medium by the first and second areas based on the detected position of the mark;

printing prescribed data on the transfer layer of the supplied intermediate transfer medium; and transferring the printed prescribed data on an image receiving medium jointly with the transfer layer.

30. A printing method comprising:

supplying an intermediate transfer medium provided with a transfer layer having a first area in a prescribed pattern, a blank and transparent second area, a third area that is equivalent to a margin, and a mark defining an unit pattern comprising the first through the third areas;

detecting the mark;

controlling a supply amount of the intermediate transfer medium in a first mode to cover the entire image receiving medium and a second mode to cover the image receiving medium by the first and second areas based on the detected position of the mark;

printing prescribed data on the transfer layer of the supplied intermediate transfer medium from the print start position.

31. A printing method comprising:

supplying an intermediate transfer medium provided with a transfer layer having a first area in a prescribed pattern, a blank and transparent second area, a third area that is equivalent to a margin, and a mark defining an unit pattern comprising the first through the third areas;

detecting the mark;

controlling a supply amount of the intermediate transfer medium up to the transfer position in a first mode to cover the entire image receiving medium by the first area and in a second mode to cover the image receiving medium by the first and second areas; and transferring the transfer layer of the supplied intermediate transfer medium over the image receiving medium jointly with the printed data on the transfer layer at the transfer position based on the detected position of the mark.

* * * * *